US005240450A

United States Patent [19]

Graham

[11] Patent Number: 5,240,450

[45] Date of Patent: Aug. 31, 1993

[54] TOY HAND GRENADE APPARATUS

[76] Inventor: David B. Graham, 212 Four Bridges Rd., Somers, Conn. 06071

[21] Appl. No.: 842,268

[22] Filed: Feb. 27, 1992

[51] Int. Cl.[5] ..... A63H 3/52; A63H 33/30; F41A 33/00; A63B 65/02

[52] U.S. Cl. ..... 446/267; 446/473; 446/475; 434/11; 273/418

[58] Field of Search ..... 446/267, 220, 221, 225, 446/473, 475, 486, 401, 398; 434/11; 273/418

[56] References Cited

U.S. PATENT DOCUMENTS

| | | | |
|---|---|---|---|
| 1,423,122 | 7/1922 | Kyriazopoulos | 446/475 |
| 3,369,486 | 2/1968 | Wrennstad et al. | 434/11 |
| 3,878,629 | 4/1975 | Scheelar et al. | 446/473 |
| 4,113,261 | 9/1978 | Sims et al. | 446/220 X |
| 4,212,460 | 7/1980 | Kraft | 446/267 X |
| 4,538,817 | 9/1985 | Ramella | 446/220 X |
| 4,761,314 | 8/1988 | Marshall | 446/267 X |
| 4,932,329 | 6/1990 | Logie | 273/418 X |
| 4,932,672 | 6/1990 | Tippmann | 273/418 X |
| 4,944,521 | 7/1990 | Greeno | 446/473 X |
| 5,018,449 | 5/1991 | Eidson, II | 446/401 X |

*Primary Examiner*—D. Neal Muir
*Attorney, Agent, or Firm*—Leon Gilden

[57] ABSTRACT

A toy assembly includes an elongate body to receive a balloon member arranged for bursting upon a timed mechanism mounted within an upper tube portion of the body projected into the body and piercing the balloon after a predetermined interval. A modification of the invention includes a medial web directed medially and orthogonally relative to the body axis dividing the body into an upper and lower body cavity receiving an upper and lower balloon therewithin, with a lower balloon arranged for bursting upon impact by the piercing member mounted resiliently within a lower end of the lower body aligned with the axis.

3 Claims, 4 Drawing Sheets

TOY HAND GRENADE APPARATUS

BACKGROUND OF THE INVENTION

1. Field of the Invention

The field of invention relates to toy grenade apparatus, and more particularly pertains to a new and improved toy hand grenade apparatus wherein the same is arranged to provide for selective bursting of a fluid-filled balloon within the grenade body.

2. Description of the Prior Art

Toy hand grenade apparatus has been utilized in the prior art for entertainment and amusement and for use in various type war game procedures. Prior art devices are set forth in the U.S. Pat. No. 4,319,426 to Lee and U.S. Pat. No. 3,878,639 to Schellar wherein the Lee patent sets forth a timer mechanism and the Schellar patent includes a fluid-filled interior body containing pressurized fluid therewithin.

Accordingly, it may be appreciated that there continues to be a need for a new and improved toy hand grenade apparatus as set forth by the instant invention which addresses both the problems of ease of use as well as effectiveness in construction in providing a timer mechanism associated with a fluid-filled body and in this respect, the present invention substantially fulfills this need.

SUMMARY OF THE INVENTION

In view of the foregoing disadvantages inherent in the known types of toy hand grenade apparatus now present in the prior art, the present invention provides a toy hand grenade apparatus wherein the same utilizes a timer mechanism to effect bursting of a balloon contained within an elongate body of the grenade structure. As such, the general purpose of the present invention, which will be described subsequently in greater detail, is to provide a new and improved toy hand grenade apparatus which has all the advantages of the prior art toy hand grenade apparatus and none of the disadvantages.

To attain this, the present invention provides a toy assembly including an elongate body to receive a balloon member arranged for bursting upon a timed mechanism mounted within an upper tube portion of the body projected into the body and piercing the balloon after a predetermined interval. A modification of the invention includes a medial web directed medially and orthogonally relative to the body axis dividing the body into an upper and lower body cavity receiving an upper and lower balloon therewithin, with a lower balloon arranged for bursting upon impact by the piercing member mounted resiliently within a lower end of the lower body aligned with the axis.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toy hand grenade apparatus which has all the advantages of the prior art toy hand grenade apparatus and none of the disadvantages.

It is another object of the present invention to provide a new and improved toy hand grenade apparatus which may be easily and efficiently manufactured and marketed.

It is further object of the present invention to provide a new and improved toy hand grenade apparatus which is of a durable and reliable construction.

An even further object of the present invention is to provide a new and improved toy hand grenade apparatus which is susceptible of a low cost of manufacture with regard to both materials and labor, and which accordingly is then susceptible of low prices of sale to the consuming public, thereby making such toy hand grenade apparatus economically available to the buying public.

Still yet another object of the present invention is to provide a new and improved toy hand grenade apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
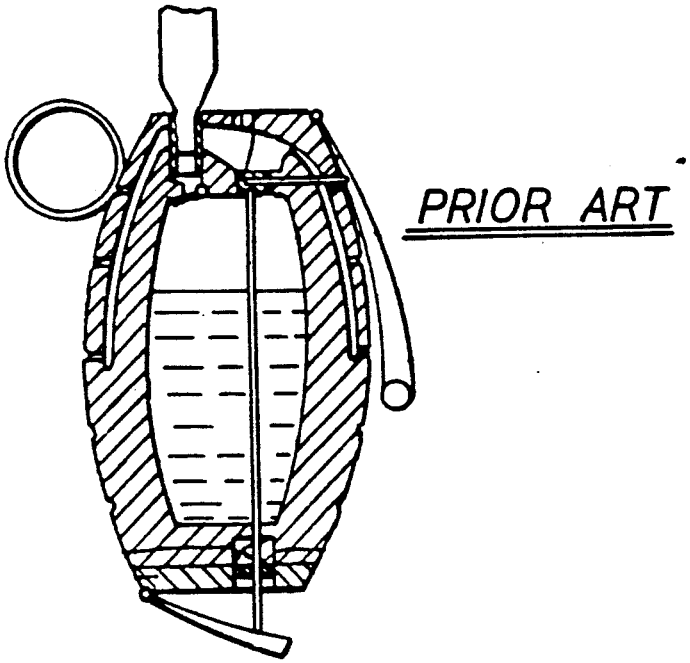
FIG. 1 is an orthographic cross-sectional illustration of a prior art toy hand grenade structure.

With reference now to the drawings, and in particular to FIGS. 1 to 8 thereof, a new and improved toy hand grenade apparatus embodying the principles and concepts of the present invention and generally designated by the reference numerals 10 and 10*a* will be described.

Figure 2:
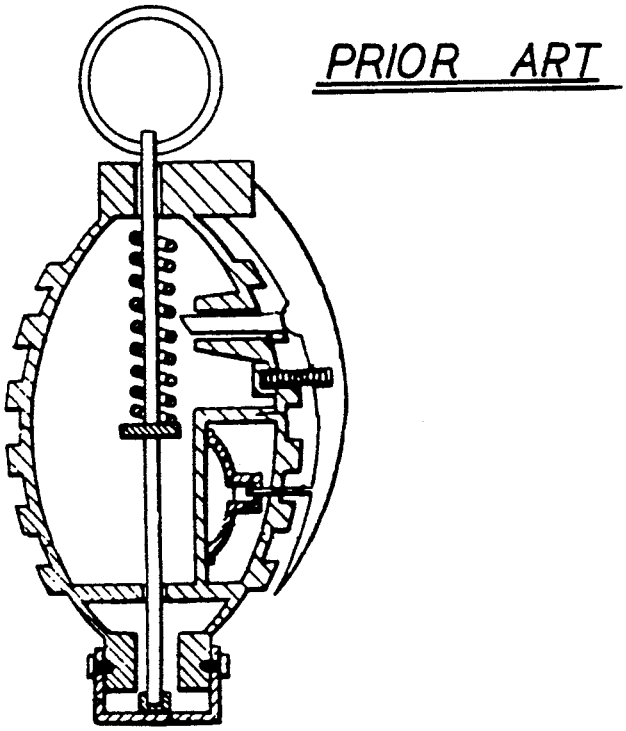
FIG. 2 is an orthographic cross-sectional illustration of a further example of a prior art toy hand grenade apparatus.
Figure 3:
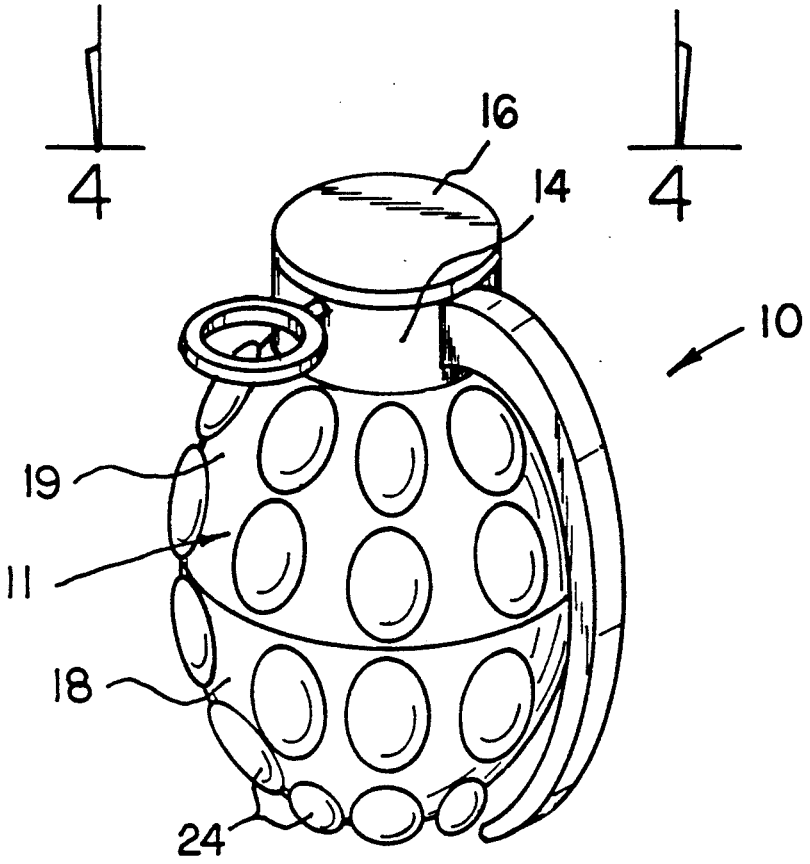
FIG. 3 is an isometric illustration of the instant invention.
Figure 4:
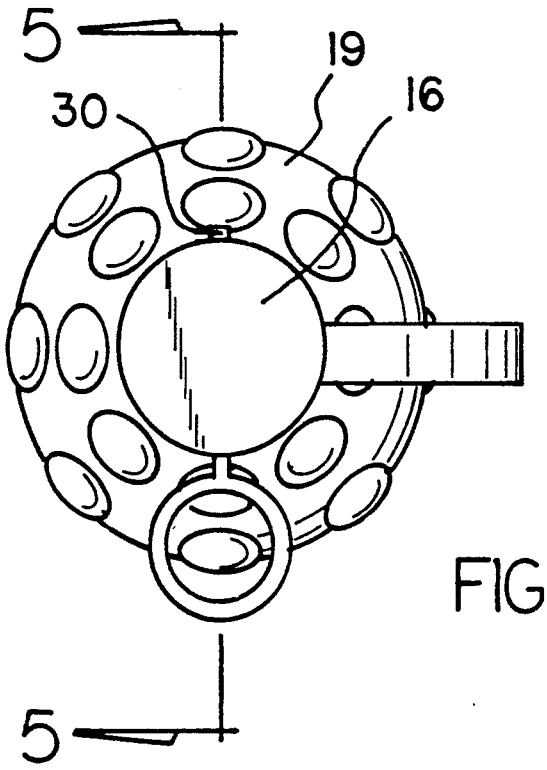
FIG. 4 is an orthographic view, taken along the lines 4—4 of FIG. 3 in the direction indicated by the arrows.
Figure 5:
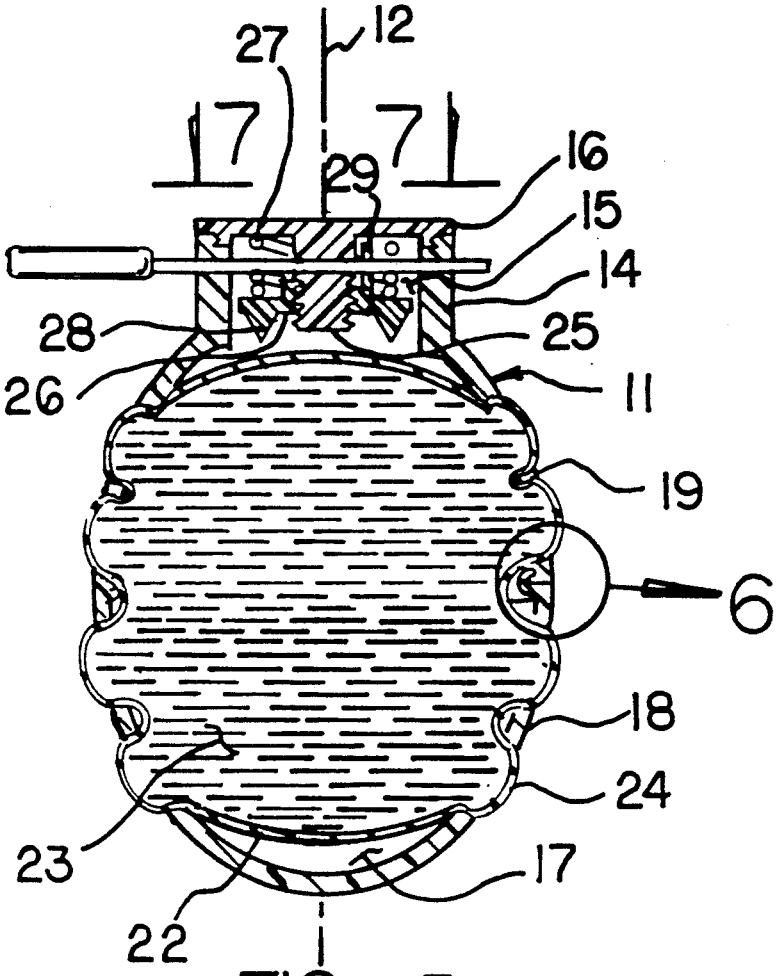
FIG. 5 is anorthographic view, taken along the lines 5—5 of FIG. 4 in the direction indicated by the arrows.
Figure 6:
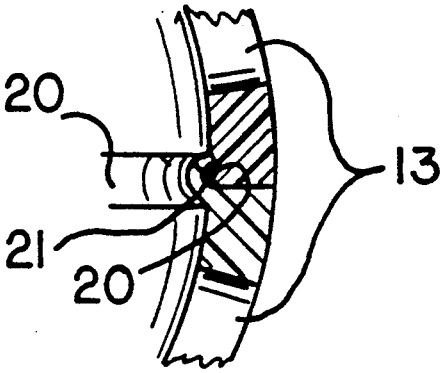
FIG. 6 is an orthographic cross-sectional illustration of section 6 as set forth in FIG. 5.
Figure 7:
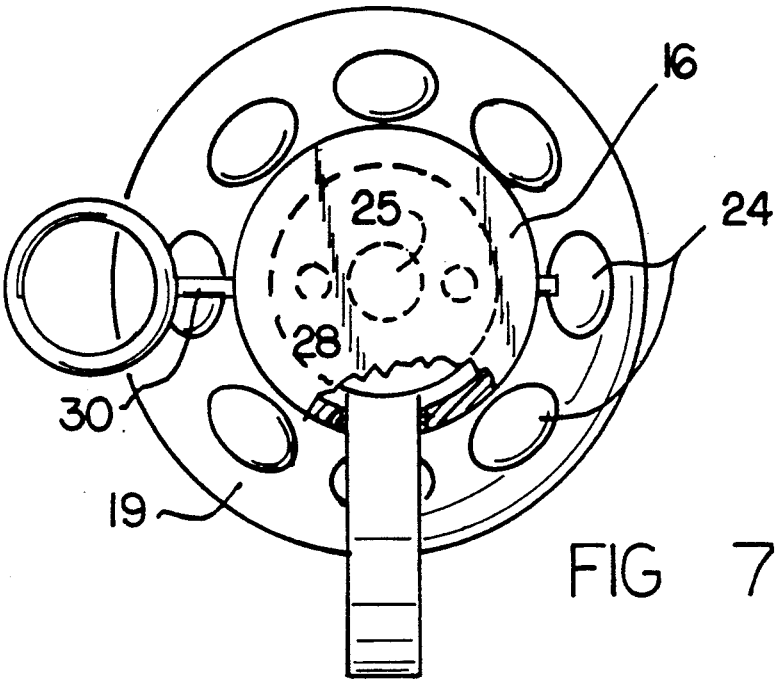
FIG. 7 is an orthographic top view of a modified aspect of the invention.

The FIGS. 1 and 2 illustrate prior art examples of toy hand grenade structure, wherein the FIG. 1 is exemplary of the U.S. Pat. No. 3,878,639 incorporating a fluid-filled toy hand grenade organization, and the FIG. 2 setting forth the illustrative details of the U.S. Pat. No. 4,319,426 setting forth a timer mechanism in association with a toy hand grenade structure.

More specifically, the toy hand grenade apparatus 10 of the instant invention essentially comprises an elongate hollow body 11 defined along a body axis 12, with a matrix of body apertures 13 directed through the body 11. The hollow body 11 includes a cylindrical body 14 coaxially aligned to the axis 12 extending upwardly to an upper distal end of the body 11 to include a cylindrical body cavity 15, with a lid cap 16 threadedly secured to an upper distal end of the cylindrical body 14. The hollow body 11 includes primary body cavity 17 within the body 11 defined by respective lower and upper body members 18 and 19 respectively, wherein the lower body 18 includes a lower body annular channel 20 orthogonally oriented relative to the axis 12 receiving an upper body annular flange 21 therewithin in a snap-fit configuration to permit reinsertion of a balloon member 22 within the primary body cavity 17, with the balloon member 22 including a fluid 23 contained therewithin. Balloon projections 24 project exteriorly of the body 11 through the matrix of body apertures 13 through the upper and lower body members 18 and 19. An externally threaded cap boss 25 is integrally and orthogonally mounted to a bottom surface of the lid cap 16 extending into the cylindrical body cavity 15 coaxially aligned relative to the axis 12. A piercer plate 26 includes a central internally threaded bore threadedly mounted about the cap boss 25, with a torsion spring 27 having its lower distal end fixedly mounted to a top surface of the piercer plate 26 and an upper distal and fixedly mounted to a bottom surface of the lid cap 16. Piercing tips 28 are fixedly mounted to a bottom surface of the piercer plate 26, wherein as the piercer plate 26 unwinds upon a previous winding of the piercer plate against the torsion spring 27, the piercing tips 28 project into the primary body cavity 17 to pierce the balloon member 22 to direct the fluid therefrom and through the associated matrix of body apertures 13. A latch pin 30 is slidably directed through the cylindrical body 14 received through the cap boss 25. Upon sliding removal of the pin 30, piercer plate 26 is permitted to unwind against action of the spring 27 to direct and project the piercing tips 28 into the balloon. Initially, the piercer plate 26 is wound upon separation of the lower body 18 relative to the upper body 19, with the pin 30 inserted therein when the piercer tips 28 are positioned within the cylindrical body cavity 15. A plate lug 29 orthogonally and fixedly mounted to a top surface of the piercer plate 26 is arranged for abutment relative to the pin 30 to prevent rotation of the piercer plate 26 relative to the cap boss 25.

Figure 8:
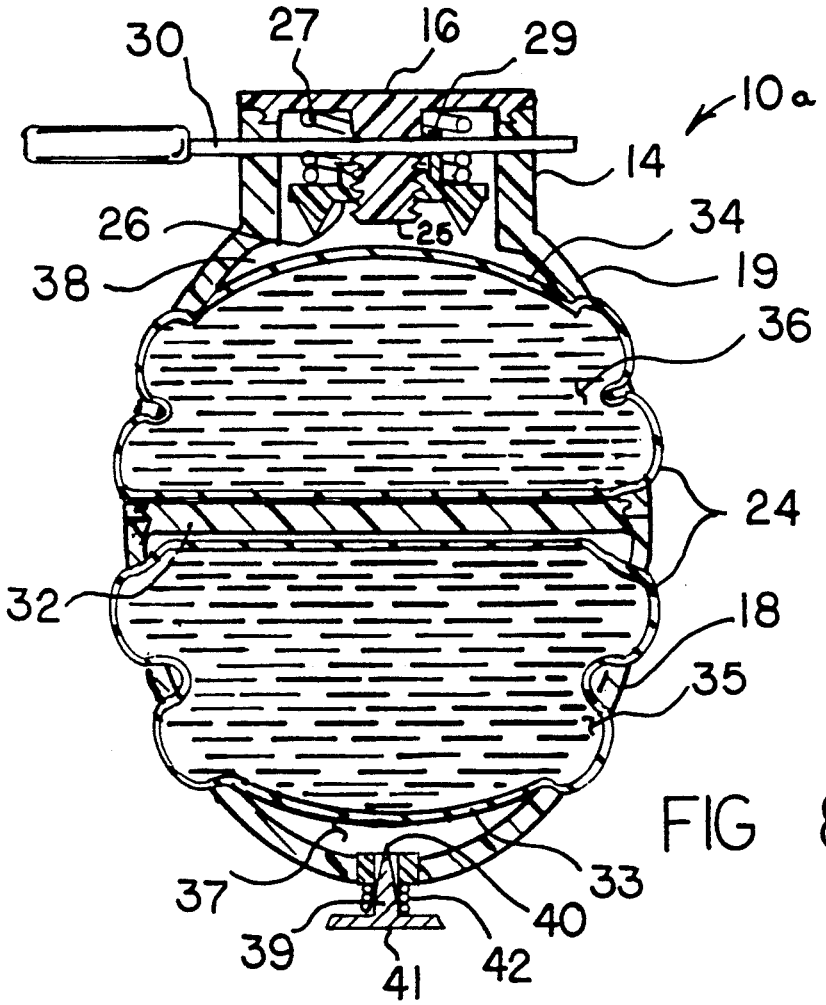
FIG. 8 is an orthographic cross-sectional illustration of the modified apparatus set forth in FIG. 7.

The FIG. 8 illustrates the use of a divider web 32 orthogonally oriented along the intersection of the upper and lower body members 19 and 18 to receive a first balloon 34 of a first fluid 36 within an upper body cavity, and a second balloon 33 including a second fluid 35 therewithin positioned within a lower body cavity 37 within the lower body member 18. Piercing of the first balloon 33 is effected upon the apparatus 10*a* being thrown and a piercer body 39 including a piercing tip 40 positioned within the lower body cavity 37 below the first balloon 34 is projected into the lower body cavity 37 against a piercer body spring 42 captured between a head plate 41 exteriorly of the lower body 18 coaxially aligned relative to the axis 12. In this manner, the piercer body tip 40 is spaced from the first balloon 33 in a first position and directed into the balloon in a second position upon impact of the head plate 41 upon a target surface. The pin 30 may be removed for subsequent timed piercing of the second balloon 34 and projection of the second fluid 36 therefrom.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toy hand grenade apparatus, comprising, an elongate hollow body, the hollow body defined along a body axis, with the hollow body including a lower body secured to an upper body, with the lower body including a lower body annular channel, and the upper body including an annular flange, with the annular flange received within the annular channel to secure the lower body to the upper body, and a balloon member positioned within the hollow body, with the balloon member including a fluid contained therewithin, the lower body and the upper body each including respective lower body apertures and upper body apertures directed through the lower body and the upper body to direct the fluid from the balloon, and a cylindrical body fixedly mounted to an upper distal end of the hollow body coaxially aligned along the body axis, with the cylindrical body including a cylindrical body cavity, with the elongate hollow body including a primary body cavity, with the hollow body cavity positioned above the primary body cavity, and piercing means mounted within the cylindrical body cavity for projection into the primary body cavity for bursting of the balloon.

2. An apparatus as set forth in claim 1 wherein the piercing means includes a lid cap threadedly secured to an upper distal end of the cylindrical body, the lid cap including a lid cap bottom surface positioned within the cylindrical body cavity, and the lid cap further including an externally threaded cap boss coaxially aligned relative to the body axis within the cylindrical body cavity, and a piercer plate threadedly mounted about the cap boss, the piercer plate including a piercer plate bottom surface and a piercer plate top surface, the piercer plate bottom surface including at least one piercing pin mounted to the piercer plate bottom surface, the piercer plate top surface including a plate lug fixedly and orthogonally mounted extending upwardly of the piercer plate top surface, and a torsion spring, the torsion spring including a first end fixedly secured to the piercer plate top surface, and a second end fixedly mounted to the lid cap, and a latch pin slidably directed through the cylindrical body and received through the cap boss in abutment with the plate lug, whereupon removal of the cap end permits rotation of the piercer plate relative to the cap boss permitting projection of the piercer pin into the primary body cavity.

3. An apparatus as set forth in claim 2 including a divider web orthogonally oriented relative to the body axis, and the lower body secured to the upper body at an intersection, with the divider web mounted within the intersection, and a further balloon mounted within the lower body below the divider web, and the further balloon including a further fluid contained therewithin, and a piercer body slidably mounted within the lower body coaxially aligned relative to the body axis, with the piercer body including a piercer body tip positioned within the lower body and a head plate mounted to an outer distal end of the piercer body exteriorly of the lower body, and a piercer body spring captured between the head plate and the lower body to bias the piercer body tip in a spaced relationship relative to the further balloon.

* * * * *